United States Patent [19]

Cawley et al.

[11] 4,186,035

[45] Jan. 29, 1980

[54] CHROMIUM CONTAINING COATING

[75] Inventors: William H. Cawley, Painesville, Ohio; Edward A. Rowe, Jr., Cheshire, Conn.

[73] Assignee: Diamond Shamrock Corporation, Cleveland, Ohio

[21] Appl. No.: 951,858

[22] Filed: Oct. 16, 1978

[51] Int. Cl.[2] ..... C23F 7/26; C23F 7/10

[52] U.S. Cl. ..... 148/6.16; 148/6.2

[58] Field of Search ..... 148/6.2, 6.16

[56] References Cited

U.S. PATENT DOCUMENTS

| | | | |
|---|---|---|---|
| 2,270,386 | 1/1942 | Sloan | 260/438 |
| 2,480,754 | 8/1949 | McCarthy | 260/438 |
| 3,437,531 | 4/1969 | Svadlenak | 148/6.2 |
| 3,556,824 | 1/1971 | Demo | 148/6.2 |
| 3,719,534 | 3/1973 | Vessey | 148/6.2 |
| 3,929,521 | 12/1975 | Ohr et al. | 148/6.2 |

FOREIGN PATENT DOCUMENTS

| | | | |
|---|---|---|---|
| 1447004 | 6/1966 | France | 148/6.2 |
| 1198324 | 7/1970 | United Kingdom | 148/6.2 |

*Primary Examiner*—Ralph S. Kendall

*Attorney, Agent, or Firm*—John J. Freer

[57] ABSTRACT

A chromium-containing treating composition, which is especially useful for rinsing phosphatized metal surfaces, contains hexavalent chromium-containing compound, methylene chloride and a substance that can be acetamide, N,N-dimethylformamide, acetone oxime and mixtures thereof. The composition is a homogeneous solution that is particularly useful where aqueous systems may create potential water pollution problems.

10 Claims, No Drawings

CHROMIUM CONTAINING COATING

BACKGROUND OF THE INVENTION

The rinsing of phosphatized metal substrates is a usual procedure and such is typically done with a chromium-containing rinse composition. The metal substrate that has been phosphatized, as by immersion in a phosphatizing bath, while in wet condition, and often after rinsing, is then typically immersed or flooded with a chromium-containing rinse composition. Subsequently, the substrate is further water rinsed and then usually dried.

Since the phosphatizing bath may be water based, the chromium-containing rinse composition can be expected to be water based, and the subsequent drying will then volatilize water from the coated substrate. Such drying may be an elevated temperature curing operation such as taught in U.S. Pat. No. 3,063,877. These rinse compositions present the problem of an aqueous system that contains a chromium ingredient.

Chromium-containing treating compositions have been proposed that combine hexavalent chromium with tertiary alcohols. Thus, in U.S. Pat. No. 3,285,788 an anhydrous system is prepared containing such a combination in a chlorinated hydrocarbon solvent. These systems may, however, present potential flammability and operator health problems. In another approach as taught in U.S. Pat. No. 3,719,534, a dichromate salt is formed with an especial organic nitrogenous base all in an organic solvent typically further containing a reducing agent for the hexavalent chromium. The composition is suited for operations where heat curing follows coating application.

In addition to aqueous phosphatizing systems, solvent based systems such as taught in U.S. Pat. No. 4,008,101, are commercially attractive. Typical operations permit the easy removal of dry, phosphatized articles from the coating operation. These, likewise, can be subjected to chromium-containing treatments, as has been taught in U.S. Pat. No. 4,070,521. It would be desirable to have a chrome-containing treatment system that is compatible with such solvent based phosphatizing operation, which treatment system would readily provide dry coatings without heat operation and which can be compatible with aqueous based phosphatizing operations and thereby obviate potential pollution hazards accompanying the use of water baths containing chromium.

SUMMARY OF THE INVENTION

A chromium-containing rinse composition is now provided which is a simplistic homogeneous solution. After application, the solution can readily provide dry, coated substrates. The resulting treated substrate will have enhanced topcoat adhesion, as for later applied paints, as well as augmented corrosion resistance, and such is the case even for treatment over bare metal surfaces. The chromium-containing treatment is carried out without risking potential water pollution problems.

In its broad concept, the invention is directed to a chromium-containing rinse composition comprising hexavalent chromium-containing compound, methylene chloride, and a substance selected from the group consisting of acetamide, N,N-dimethylformamide, acetone oxime and mixtures thereof. It is understood that some to all of the hexavalent chromium-containing compound and such substance can be present in the composition as the reaction products thereof.

In a further aspect, the invention is directed to the preparation of a chromium-containing rinse composition and also to the providing of a corrosion resistant coating on a metal substrate.

DESCRIPTION OF THE PREFERRED EMBODIMENTS

The methylene chloride, or the "methylene chloride constituency" as it is sometimes referred to herein, is typically commercially available methylene chloride and may contain additional ingredients, although the use of a more purified methylene chloride is contemplated. The methylene chloride may then contain very minor amounts of additional substances such as other chlorinated hydrocarbons, including chloroform and vinylidene chloride. It is further contemplated to use as the methylene chloride constituency, methylene chloride blended with a minor amount of additional solvent. Preferably, the additional solvent will be non-flammable and will form an azeotrope with the methylene chloride on heating, e.g., trichlorotrifluoroethane. The methylene chloride constituency, e.g., the methylene chloride oran azeotropic blend, will provide greater than about 88 weight percent, and typically greater than about 95 weight percent, of the total composition.

The composition will contain chromic acid as the hexavalent-chromium-providing substance or its equivalent, for example, chromium trioxide or chromic acid anhydride. But a minor amount, e.g., 20 percent or less, of such chromium can be supplied by a salt such as ammonium dichromate, or by sodium or potassium salts, or by substances such as calcium, barium, magnesium, zinc, cadmium, and strontium dichromate. Additionally, a minor amount such as 20 percent or less of the hexavalent-chromium-providing substance might be a mixed chromium compound, i.e., include trivalent chromium compounds. The liquid composition might contain as little as about 0.01 weight percent of hexavalent chromium, expressed as $CrO_3$, with the composition still affording desirable corrosion resistance to subsequently treated substrates. On the other hand, the composition may contain as much as about 2 weight percent of hexavalent chromium, expressed as $CrO_3$, although the more concentrated compositions can yield surface staining during treatment and, if so, should be diluted. The composition typically contains from about 0.05 up to about one weight percent of hexavalent chromium, expressed as $CrO_3$.

The third critical constituent of the rinse composition is acetamide, or N,N-dimethylformamide, or acetone oxime or mixtures of the foregoing. When any or all of these ingredients are present in the rinse composition, it is to be understood that some to all of the hexavalent chromium-containing compound can be present with such substances as a reaction product thereof. Since the N,N-dimethylformamide is liquid at ordinary temperature and pressure, it is readily incorporated into the rinse composition. However, under the same conditions, acetamide and acetone oxime are solids. The use of these solids can be facilitated by preparing a solution of same in a suitable solvent. The solvents for this use can include N,N-dimethylformamide and dimethylsulfoxide. In the formulation of the rinse composition, it is preferred for safety in preparation, that a blend is first prepared with methylene chloride plus the acetone oxime or the like. When the acetamide or acetone oxime are used, they are generally used in preparing the blend with methylene chloride as a preblended adjuvant solution in suitable solvent as discussed hereinabove. Thereafter, the hexavalent chromium containing compound is admixed with the blend. For efficient corrosion protection of the subsequently treated substrate, the composition should contain at least about 0.01 weight percent of the acetamide or the like. For economy, the composition will contain less than about 10 weight percent of this ingredient. Advantageously, for efficient treatment combined with best economy, the composition will contain between about 0.02-6 weight percent of the ingredient. Preferably, the ingredient used will be N,N-dimethylformamide.

Although it is not preferred, it is contemplated that the rinse composition can contain additional ingredients such as molybdic, or vanadic acids or surface active agents. But such are contemplated to be present in a very minor amount.

The composition can be applied by any conventional means for applying a liquid coating composition to a metal surface, e.g., by any of the various methods such as dip coating, roller coating, pressure spray or combinations of such methods such as spray and brush techniques. Thereafter, the coated surface is dried. This can be simply air drying at ambient temperature although force drying techniques may be used. Typically, simple air drying at ambient temperature will provide a resulting coated surface dry to the touch in a matter of a few minutes, e.g., in only 2 to 3 minutes. Such dried surface can be obtained following application to a previously coated metal substrate such as a phosphatized substrate or to a freshly prepared clean metal surface. Where a metal surface is treated, it is desirably one that has been thoroughly cleaned such as by use of a commercial alkaline cleaning composition or by degreasing or combination of such treatments.

Where the coating composition is applied over a previously phosphatized metal surface, such phosphatizing can be any of the phosphatizing processes such as aqueous phosphatizing or solvent phosphatizing. The aqueous phosphatized surfaces can include those that are provided with a heavy metal phosphate coating over a surface such as steel, zinc, iron and aluminum. The solvent phosphatizing systems can be typically those using a solvent such as trichloroethylene or perchlorethylene, as discussed in U.S. Pat. No. 3,306,785. Most usually, such a solvent phosphatized surface will be prepared from a methylene chloride based solvent phosphatizing bath such as disclosed in U.S. Pat. No. 4,008,101. Additional phosphatizing baths also useful in preparing the phosphatizing surface, and containing minor amounts of water, have been discussed in U.S. Pat. No. 4,029,523.

After application of the coating composition to a substrate, such can typically display desirably enhanced adhesion for subsequently applied topcoats. The subsequently applied topcoats may include any suitable paint, i.e., a paint, primer, enamel, varnish, or lacquer. The resulting coating from the composition is susceptible to painting by such paints that are solvent reduced or water reduced. Additional suitable paints which can be used include oil paints.

The following examples show ways in which the invention has been practiced but should not be construed as limiting the invention. In the examples, all parts are weight parts unless otherwise specified. In the examples, the following procedures have been employed.

Preparation of Test Panels

Bare steel test panels, 6"×4" or unless otherwise specified, and all being cold rolled, low carbon steel panels are typically prepared for phosphatizing by degreasing for 15 seconds in a commercial degreasing solution maintained at its boiling point. Panels are removed from the solution, permitted to dry in the vapor above the solution and are thereafter ready for phosphatizing.

Phosphatizing of Test Panels and Coating Weight

Unless otherwise specified, fresh steel panels are either used fresh or are cleaned and degreased by immersing the panels into hot phosphatizing solution maintained at its boiling point for a time of about one minute. Panels removed from the solution pass through the vapor zone above the phosphatizing solution until liquid drains from the panel; dry panels are then removed from the vapor zone.

The phosphatized coating weight for selected panels, expressed as weight per unit of surface area, is determined by first weighing the coated panel and then stripping the coating by immersing the coated panel in an aqueous solution of 5% chromic acid which is heated to 160°-180° F. during immersion. After panel immersion in the chromic acid solution for 5 minutes, the stripped panel is removed, rinsed first with water, then acetone, and air dried. Upon reweighing, coating weight determinations are readily calculated. Coating weight data is presented in milligrams per square foot (mg/ft$^2$).

Corrosion Resistance Test ASTM B-117-64

Corrosion resistance of coated panels is measured by means of the standard salt spray (fog) test for paints and varnishes, ASTM B-117-64. In this test, the panels are first cut through to the steel, in an X configuration on the panel surface, and are then placed in a chamber kept at constant temperature where they are exposed to a fine spray (fog) of a 5% salt solution for specified periods of time. After the panels are removed from the chamber, they are washed with deionized water, scrubbed with a commercial cleanser using a paper towel, and then dried. Thereafter, a strip of tape coated with a pressure sensitive adhesive is pressed against each scribe line of the panel and then quickly removed. The figures presented in the examples, e.g., "0/32", indicates the inches, expressed in thirty-seconds of an inch, of coating failure away from scribe lines.

Relative Humidity Test ASTM D-1748

In this test, water is heated in the bottom of a cabinet, and/or air is bubbled into the water at the bottom of the cabinet, to produce a condition of 100 percent humidity in the cabinet. The temperature for the ambient steam within the cabinet is 120° F. Panels are suspended vertically in the cabinet on a rotatable frame above the water surface; the bottom edge of a 4"×6" panel is about 14 inches above the water surface. To terminate the test, panels are removed for inspection at the times shown in the appropriate example below. Upon removal, panels are air dried and visually inspected for comparison, one with the other, and for ratings as more specifically described in the examples.

EXAMPLE 1

To 100 parts of stabilized, commercially available technical grade methylene chloride there is added, with agitation, 21.5 parts of methanol, 5.0 parts deionized water, 4.6 parts, N,N-dimethylformamide, 0.09 part dinitrotoluene, 0.04 part pentaphen, 0.02 part p-benzoquinone, and 0.33 part of 85% strength orthophosphoric acid. The bath is heated to reflux and panels, prepared as described above, are coated in the above discussed manner. Coating weights for panels are determined in the hereinbefore described manner and are found to be 40 mg/ft.$^2$ Several different rinse compositions are then prepared, each to contain 594.9 parts of methylene chloride. The number one (No. 1) composition additionally contains 9.44 parts of N,N-dimethylformamide and 0.725 part of chromic acid. The No. 2 composition contains 18.88 parts of N,N-dimethylformamide and 0.736 part of chromic acid. The No. 3 composition contains 0.44 part of acetone oxime and 0.6 part of chromic acid. The No. 4 composition contains 1.32 part of acetone oxime and 0.6 part of chromic acid. The No. 5 composition contains 14.16 parts of N,N-dimethylformamide, 0.18 part of acetamide, and 1.2 parts of chromic acid. The No. 6 composition contains 21.24 parts of N,Ndimethylformamide, 0.44 part of acetamide and 0.75 part of chromic acid. In each case, chromium-free blends were first prepared, and the chromic acid then carefully added to these blends, with agitation. Moreover, with both the No. 5 and No. 6 compositions, the first preparation step involved the dissolving of the acetamide in the N,N-dimethylformamide.

Each bath is used by taking a phosphatized panel, prepared in the above-described manner, and immersing in one of the baths for 15 seconds. The panel is then removed from the bath, permitted to air-dry in the ambient atmosphere for 5 minutes before being painted.

An additional, comparative, test panel is used herein for evaluation purposes. It is a panel phosphatized with an aqueous phosphatizing composition and prepared in accordance with specifications that are generally accepted as standards for performance in the automotive and household appliance industries. This comparative test panel, for convenience, is generally referred to herein as the "comparative panel". Such aqueous composition is a solution that can contain iron phosphate, with the test panel being dipped in this aqueous solution typically for one minute. Thereafter, the test panel is rinsed and then immersed in a dilute solution of chromic acid. Such test panel is then dried and is thus provided with a chromic acid rinse coating.

All test panels are painted, before testing, with a commercial enamel topcoat applied with a draw bar. The enamel is a commercial white alkyd baking enamel; the enamel ostensibly contains a modified alkyd resin based upon a system of partially polymerized phthalic acid and glycerin and has 50 weight percent solids. After coating panels with the enamel, the coating is cured on all panels by baking in a convection oven for 35 minutes at a temperature of 300° F.

All resulting panels are then scribed with an X configuration and subjected to salt spray testing as described hereinabove. The duration of the test, and the test results are reported in the table below.

TABLE 1

| Chrome Rinse Solution No. | Salt Spray Paint Loss* 118 Hours |
|---|---|
| Comparative Panel | 5.5/32 |
| No. 1 | 1/32 |
| No. 2 | 1/32 |
| No. 3 | 3/32 |

TABLE 1-continued

| Chrome Rinse Solution No. | Salt Spray Paint Loss* 118 Hours |
|---|---|
| No. 4 | 3/32 |
| No. 5 | 1/32 |
| No. 6 | 1.5/32 |

*Average of two panels.

EXAMPLE 2

Panels that have been phosphatized with a composition like that described hereinabove, and in the manner as above-described, are thereafter provided with a chrome rinse. To individual portions of chrome rinse compositions, each containing 1,190 parts methylene chloride and 94.4 parts N,N-dimethylformamide, there is added chromic acid to provide separate compositions containing 0.5 gram per liter, 0.76 gram per liter, 1 gram per liter, 1.25 grams per liter, 1.5 grams per liter and 2 grams per liter of chromic acid. Phosphatized panels are dipped in these chrome rinse compositions, two panels for each composition. One panel is dipped for 30 seconds and one panel for one minute.

All panels are thereafter air-dried at ambient temperature. These panels, plus a comparative panel as described in Example 1, plus a phosphatized only panel, and one that has been phosphatized and oiled, are all subjected to the relative humidity test described hereinabove in connection with the examples. Both the phosphatized and the phosphatized and oiled panel contain a phosphate coating such as described in Example 1. The oil used has been found to be suitable in the metal working industry in pressing, cutting and grinding operations. It is applied to the panel by soaking the panel in the oil, then removing the panel and draining, lightly rubbing the pannel with a cloth towel to remove excess oil.

Upon removing the panels from the relative humidity test after 16 hours of testing, all panels are visually inspected. The panels rinsed in accordance with the present invention are superior in corrosion resistance to the commercial panel as well as to the phosphate panel and the phosphate and oiled panel, with an exception. The exception are the panels coated in the 0.5 gram per liter solution. These panels are judged to be only slightly inferior to the commercial panel.

EXAMPLE 3

Panels that have been phosphatized with a composition like that described hereinabove, and in the manner as above-described, are thereafter provided with a chrome rinse. The rinse composition contains 5949 parts methylene chloride, 188.8 parts N,N-dimethylformamide and 0.05 part of chromic acid, with the chromic acid being slowly aded to the mixture of methylene chloride and N,N-dimethylformamide to prepare the composition. Two phosphatized panels are dipped for 15 seconds in this chrome rinse composition. Both panels are thereafter air-dried at ambient temperature; these panels are noted hereinbelow as the "improved" panels.

Two additional test panels, these being the "comparative" panels of Example 1, which term is also used herein, are employed as controls. All panels are painted with the commercial enamel topcoat of Example 1, in the manner as described in Example 1. After topcoating, the enamel is cured as discussed in Example 1. The panels are then scribed with an X configuration and subjected to salt spray testing as described hereinabove. The duration of the test, and the test results are reported in the table below.

TABLE 2

| Panel | Salt Spray Paint Loss* 118 Hours |
|---|---|
| Comparative | 5.5/32 |
| Improved | 1.5/32 |

*Average of two panels.

These results are deemed to be highly desirable. However, when the proportions of methylene chloride and N,N-dimethylformamide are the same or essentially the same as those used hereinabove, it is preferred to use about 0.05 weight percent of chromic acid.

What is claimed is:

1. A chromium-containing rinse composition adapted for application to a coated metal substrate, said composition comprising hexavalent chromium-containing compound, methylene chloride, and a substance selected from the group consisting of acetamide, N,N-dimethylformamide, acetone oxime and mixtures thereof, with the proviso that some to all of said hexavalent chromium-containing compound and said substance can be present in said composition as the reaction products thereof.

2. The composition of claim 1 containing from about 0.01 to about 2 weight percent of said hexavalent chromium-containing compound, from about 0.01 to about 10 weight percent of said substance, and a balance of methylene chloride.

3. The composition of claim 1 containing between about 0.02-10 weight percent of said N,N-dimethylformamide.

4. The composition of claim 1 wherein said substance is a solution of a substance selected from the group consisting of acetamide, acetone oxime, and mixtures thereof, in a solvent selected from the group consisting of dimethylsulfoxide and N,N-dimethylformamide.

5. The composition of claim 1 wherein said hexavalent chromium-containing compound is chromic acid.

6. The method of preparing a chromium-containing rinse composition adapted for application to a coated metal substrate, which method comprises preparing a blend of methylene chloride with a substance selected from the group consisting of acetamide, N,N-dimethylformamide, acetone oxime and mixtures thereof, and thereafter admixing hexavalent-chromium-containing compound with aid blend.

7. The method of claim 6 wherein chromic acid is admixed to a blend of methylene chloride and N,N-dimethylformamide.

8. The method of claim 6 further characterized by preparing a solution of a substance selected from the group consisting of acetamide, acetone oxime, and mixtures thereof, with a solvent selected from the group consisting of dimethylsulfoxide and N,N-dimethylformamide and thereafter blending said solution with methylene chloride.

9. The method of providing corrosion resistance for a metal substrate which method comprises contacting said substrate with a chromium-containing rinse composition comprising hexavalent chromium-containing compound, methylene chloride and a substance selected from the group consisting of acetamide, N,Ndimethylformamide, acetone oxime and mixtures thereof, and drying the resulting contacted substrate, with the proviso that some to all of said hexavalent chromiumcontaining compound and said substance can be present in said composition as the reaction products thereof.

10. The method of claim 9 wherein said substrate brought into contact with said composition is a phosphatized metal substrate.

* * * * *